United States Patent [19]

Hinzen

[11] Patent Number: 4,967,725

[45] Date of Patent: Nov. 6, 1990

[54] METHOD AND APPARATUS FOR MANUFACTURING SEMICONDUCTOR WAFERS AND CUTTING WIRE APPARATUS FOR USE THEREIN

[75] Inventor: Hubert Hinzen, Eckental, Fed. Rep. of Germany

[73] Assignee: GMN Georg Muller Nurnberg AG, Fed. Rep. of Germany

[21] Appl. No.: 311,932

[22] Filed: Feb. 16, 1989

[30] Foreign Application Priority Data

Feb. 17, 1988 [DE] Fed. Rep. of Germany ..... 3804873

[51] Int. Cl.[5] ..... B28D 1/08

[52] U.S. Cl. ..... 125/21; 51/135 R; 83/651.1; 83/661

[58] Field of Search ..... 125/21, 22; 83/651.1, 83/661, 788; 51/135 R, 136, 137, DIG. 9

[56] References Cited

U.S. PATENT DOCUMENTS 3,155,087 11/1964 Dreyfus ..... 125/21

3,824,982 7/1974 Bowman ..... 125/21

4,484,502 11/1984 Ebner ..... 83/651.1

*Primary Examiner*—Frederick R. Schmidt

*Assistant Examiner*—M. Rachuba

*Attorney, Agent, or Firm*—Steinberg & Raskin

[57] ABSTRACT

Wafers are manufactured from an ingot of semiconductor material by first machining a front face of the ingot to provide a substantially planar reference surface and then slicing the ingot using looped cutting wire apparatus. The cutting wire apparatus includes a looped cutting wire and at least two drive rollers over sectors of which the cutting wire is wrapped. Each drive roller is provided with its own drive motor which has shunt motor characteristics. The speed and torque of each motor is adjustable relative to the load applied to its drive roller by the cutting wire such that all of the drive rollers participate in driving the cutting wire with substantially the same reliability against slippage so that wear is distributed uniformly over all of the drive rollers.

2 Claims, 9 Drawing Sheets

FIG. 4a
PRIOR ART
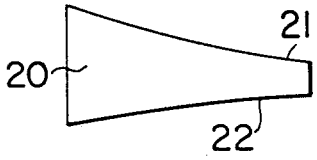
FIG. 4b
PRIOR ART
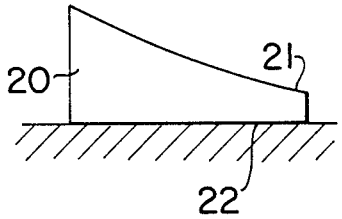
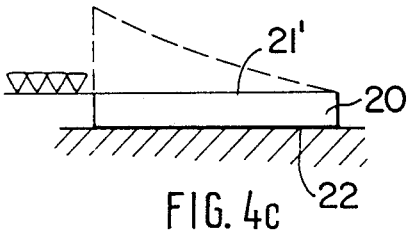
FIG. 4c
PRIOR ART
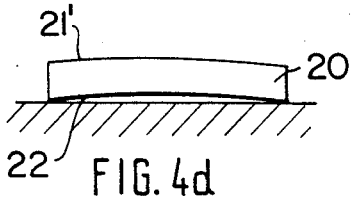
FIG. 4d
PRIOR ART
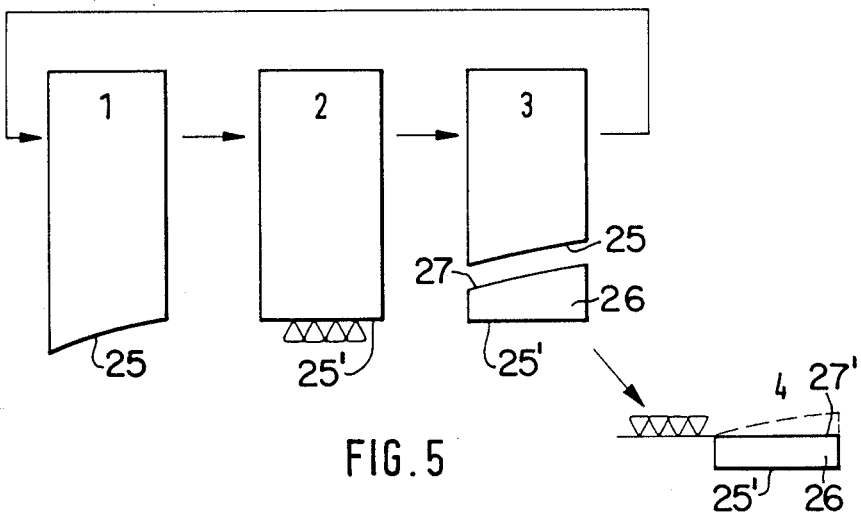
FIG. 5

METHOD AND APPARATUS FOR MANUFACTURING SEMICONDUCTOR WAFERS AND CUTTING WIRE APPARATUS FOR USE THEREIN

BACKGROUND OF THE INVENTION

This invention relates generally to methods and apparatus for manufacturing semiconductor wafers and cutting wire apparatus for use in such methods and apparatus.

The particular properties of hard, brittle non-metallic semiconductor material having a Vickers hardness of up to HV 15,000 N/mm$^2$ result in rigorous demands being placed on the cutting or slicing process by which wafers are manufactured from the material.

In the manufacture of semiconductor wafers, elongated bars or ingots are cast from or pulled out from a melt of the semiconductor material. Further processing of the material requires a slice-by-slice separation of these ingots into wafers. The separation process is characterized by at least the following two requirements:

(a) cutting losses must be minimized since the material is very expensive due to the complex manner in which it is obtained in highly pure form, e.g., the width of the cut should be significantly less than the thickness of the wafer, i.e., about 1 mm; and (b) the sliced wafers should have surfaces which are as planar and as parallel to each other as possible.

Regarding the manner of cutting or slicing, arrangements in which looped cables are driven to cut through material have been known in principle for many years. For example, such arrangements have been used to cut rocks into square blocks. Generally, the moving cable is pulled against the workpiece while an abrasive agent and coolant-lubricant is applied whereby the cable slices through the workpiece. Although the cutting capacity of such arrangements is relatively modest, they are still in use today in quarries and in other applications in which precise cutting tolerances are not required.

Significant improvements in productivity of looped cable cutting processes has been achieved by providing abrasive agent directly onto the cable either in the form of discrete elements, such as by clamping a sleeve having an abrasive outer surface firmly onto the cable, or by fixing the abrasive agent onto the cable itself.

Since the precision of the cut obtained by a cutting cable as well as the cutting capacity of the cable both increase with increasing cable tension, cables having higher tensile strength are now used in many cable cutting applications. Indeed, traditional hemp rope no longer plays a role in modern industrial practice.

The present state of technology is such that it is quite possible to cut or slice very hard materials by means of cutting wire arrangements in which diamond coated wires or wires which function to carry loosely added cutting medium are used. A serious problem, however, arises from the demand for a minimum cutting width, such as in the case of manufacturing semiconductor wafers. In particular, whereas wires having a diameter as small as 1 mm enable the requisite tensile and cutting forces to be transferred to the wire using conventional drive mechanisms, the cutting width required in slicing wafers from ingots of semiconductor material necessitates reducing the wire diameter to only a few tenths of a millimeter. Such extremely thin cutting wires can only be used, however, if the tensile strength of the wire is approached in receiving the tensile and cutting forces.

In this respect, the design of the arrangement by which the driving forces are applied to the cutting wire assumes special significance, i.e., the drive arrangement must be designed so that the tension in the wire, which is limited by the strength and thickness of the wire, will generate a maximum cutting force.

Countervailing considerations exist in connection with the tension and no-load forces acting on a cutting wire during a slicing operation. On the one hand, the tension and no-load forces must be sufficient to effect sliding of the wire within the cut being formed in the workpiece in order to complete a separation process. On the other hand, however, the same tension and no-load forces must not effect sliding of the wire over any of the drive components since this would cause the wire to cut the drive component itself, especially in the case where extremely thin cutting wires are used. This problem is magnified due to the widely fluctuating magnitude of the friction between the cutting wire and the workpiece and/or between the cutting wire and the drive mechanism.

The requirements described above are simultaneously achieved by providing that the extent to which the cutting wire wraps around sectors of the drive rollers of the drive mechanism on the driving side of the wire is sufficiently large. A large wrap-around curvature is generally obtained by providing several drive rollers over sectors of which the cutting wire is wrapped. However, the provision of several drive rollers in order to distribute forces over their respective sectors is useful on a practical basis only if the driving effect of the individual rollers are precisely adjusted with respect to each other. A proportionate division of torque resulting from an arrangement in which a common motor drives all of the drive rollers is not satisfactory since expansion slip results in unavoidable wear, particularly in the partial load region and primarily on the first drive roller. Such wear increases the maintenance intervals and, therefore, the down time of the machine. Moreover, a mechanical coupling of the drive rollers with each other is not practical using presently available technology. For example, a mechanical coupling of the drive rollers, such as by a toothed gear arrangement, limits the speed of rotation of the drive rollers, due to lubrication and other considerations, to speeds well below those required for wire cutting processes. The division of torque between the drive rollers obtained by friction couplings is not satisfactory since slippage between the drive rollers is unavoidable. Such slippage will of course be transmitted to the drive rollers wrapped by the cutting wire thereby resulting in increased wear of one or more of the drive rollers.

To the present, no solution has been found to the problems discussed above, and for these reasons looped cutting wire arrangements for use in applications where large cutting forces, minimum cutting widths and high precision are critical have not progressed beyond the experimental stage and have not been practical in industrial processes.

SUMMARY OF THE INVENTION

Accordingly, it is an object of the present invention to provide new and improved methods and apparatus for manufacturing semiconductor wafers using looped cutting wire arrangements.

Another object of the present invention is to provide new and improved drive apparatus for looped cutting wire arrangements which facilitate their use in cutting or slicing operations in which large cutting forces, minimum cutting widths and/or high precision are required.

A further object of the present invention is to provide new and improved methods and apparatus for manufacturing semiconductor wafers including a substantially planar reference surface.

Briefly, in accordance with the present invention, these and other objects are obtained by providing in looped cutting wire apparatus including a looped cutting wire and at least two drive rollers, a number of motors corresponding to the number of drive rollers, with each motor driving a respective one of the drive rollers, each motor including means for adjusting its rate of rotation and angular torque characteristics, either electrically or mechanically, in a manner so that the total force applied by the cutting wire to the individual drive rollers is distributed in a manner such that, (a) the individual drive rollers participate in the driving of the cutting wire with substantially the same reliability against slippage with respect to the cutting wire so that the driving force transmitted by each of the rollers is maximized; and (b) wear caused by expansion slip is distributed substantially uniformly with respect to all of the drive rollers.

With regard to the second of the two requirements for semiconductor wafer manufacture mentioned above, i.e., for planar parallel wafer surfaces, the use of a looped cutting wire to slice wafers from an ingot cannot achieve a precisely planar surface since fluctuating process forces and the non-uniform cutting capacity of the cutting wire due to continuing wear and tear cause the wire to deviate in direction during the cutting operation. In order to provide the wafer with a precisely planar reference surface to enable the other wafer surface to be precisely planed in parallel relationship with the reference surface in a subsequent processing step, the front face of the ingot is machined prior to slicing the wafer to provide a substantially planar surface. A wafer including the previously planed surface is then sliced from the ingot by the looped cutting wire.

DESCRIPTION OF THE DRAWINGS

A more complete appreciation of the present invention and many of the attendant advantages thereof will be readily understood by reference to the following detailed description when considered in connection with the accompanying drawings in which:

FIGS. 4*a*–4*d* are schematic illustrations showing the steps in a conventional method for manufacturing wafers;

FIG. 5 is a schematic illustration showing the steps in manufacturing a wafer having a substantially planar reference surface.

DESCRIPTION OF THE PREFERRED EMBODIMENT

Figure 1:
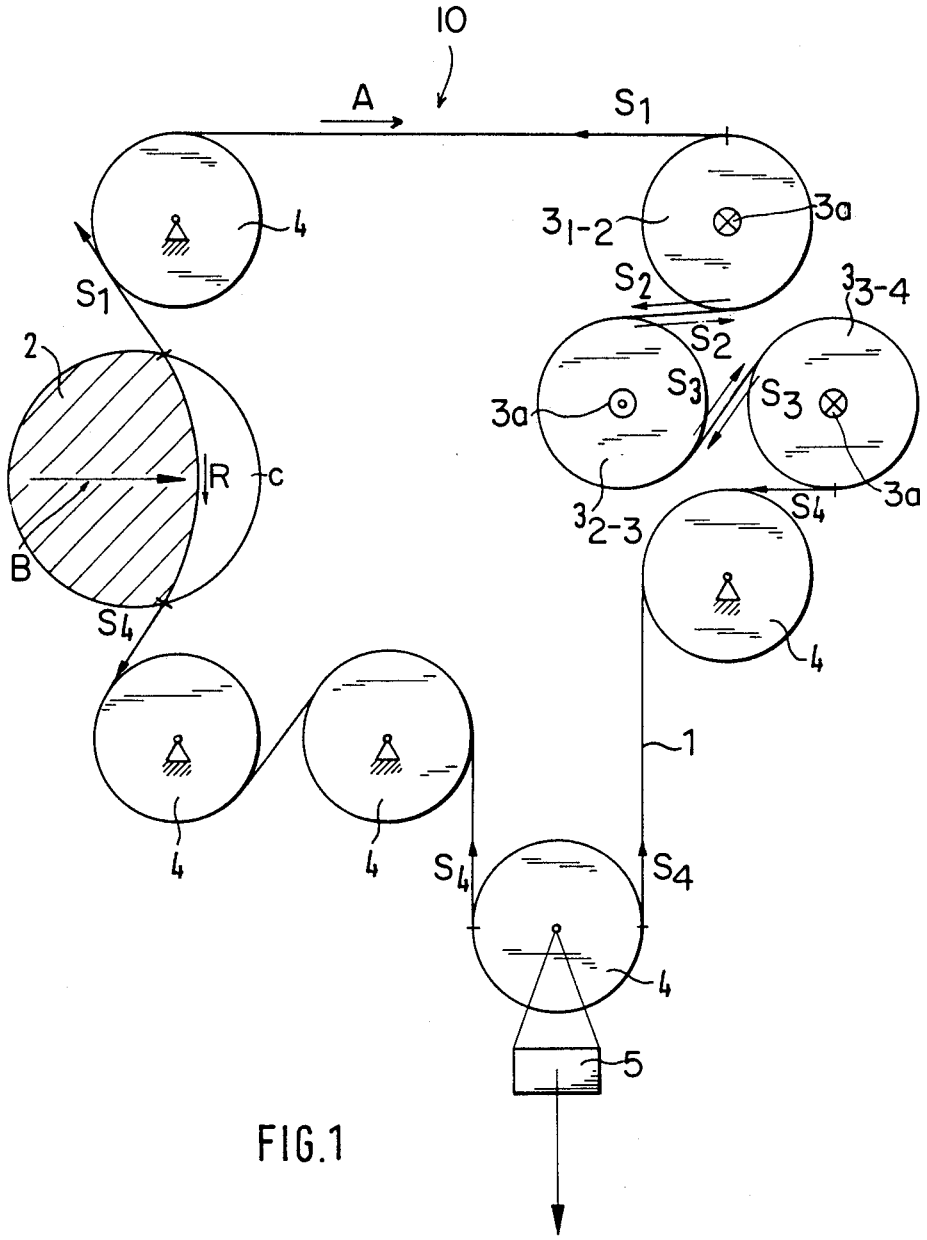
FIG. 1 is a schematic illustration of an arrangement for slicing an ingot in accordance with the invention.

Referring now to the drawings wherein like reference characters designate identical or corresponding parts throughout the several views, and more particularly to FIG. 1, looped cutting wire apparatus in accordance with the invention, generally designated 10, is illustrated. Generally, a looped cutting or sawing wire 1 is driven by drive rollers 3 in the direction of arrow A and engages a cylindrical ingot 2 of semiconductor material as the ingot advances in a radial or transverse direction, designated by arrow B, to form a cut C in the ingot.

The looped cutting wire 1 is guided by guide rollers 4 which do not affect the tensile force acting on the wire 1. In accordance with the invention, the cutting wire 1 is driven by three drive rollers 3, each of which is driven by its own drive motor, schematically shown at 3*a*. It is desireable to maximize the angle or length of the sector of each drive roller 3 around which the cutting wire 1 wraps, i.e., the total wrap-around angle. To this end, the three drive rollers 3 are arranged close to each other with their parallel axes of rotation located at the corners of an equilateral triangle.

Still referring to FIG. 1, the tension force acting on the wire 1 in a segment extending between adjacent rollers is designated S. Due to the process forces created during operation, a frictional force R acts on the cutting wire 1 within cut C of ingot 2. The frictional force R represents the difference in the magnitude between the larger tension force $S_1$ on the drive side of the cutting wire loop and the smaller tension force $S_4$ on the no-load side of the cutting wire loop. The no-load tension force $S_4$ is maintained at a constant magnitude, such as through a weight-and-spring mechanism 5.

The magnitude of the tension forces S acting on the segments of the cutting wire 1 between successive drive rollers 3 are intermediate of the tension forces $S_4$ and $S_1$ and are of diminishing value in the direction of run of wire 1. In particular, the magnitude of the tension force $S_2$ in the section of wire 1 between drive rollers $3_{1\text{-}2}$ and $3_{2\text{-}3}$ is less than the magnitude of $S_1$ while the magnitude of tension force $S_3$ in the section of wire 1 between drive rollers $3_{2\text{-}3}$ and $3_{3\text{-}4}$ is less than the magnitude of tension force $S_2$, but greater than the no-load tension force $S_4$. The actual values of the tension forces $S_2$ and $S_3$ depend upon the extent to which each of the drive rollers participates in driving the cutting wire 1. In order to function in accordance with the invention, the torque and speed of each of the drive motors 3*a* are adjusted to provide a reliable friction force transmission from its associated drive roller to the cutting wire to eliminate slippage between them to thereby maximize the participation of each of the drive rollers in driving the cutting wire.

Figure 2:
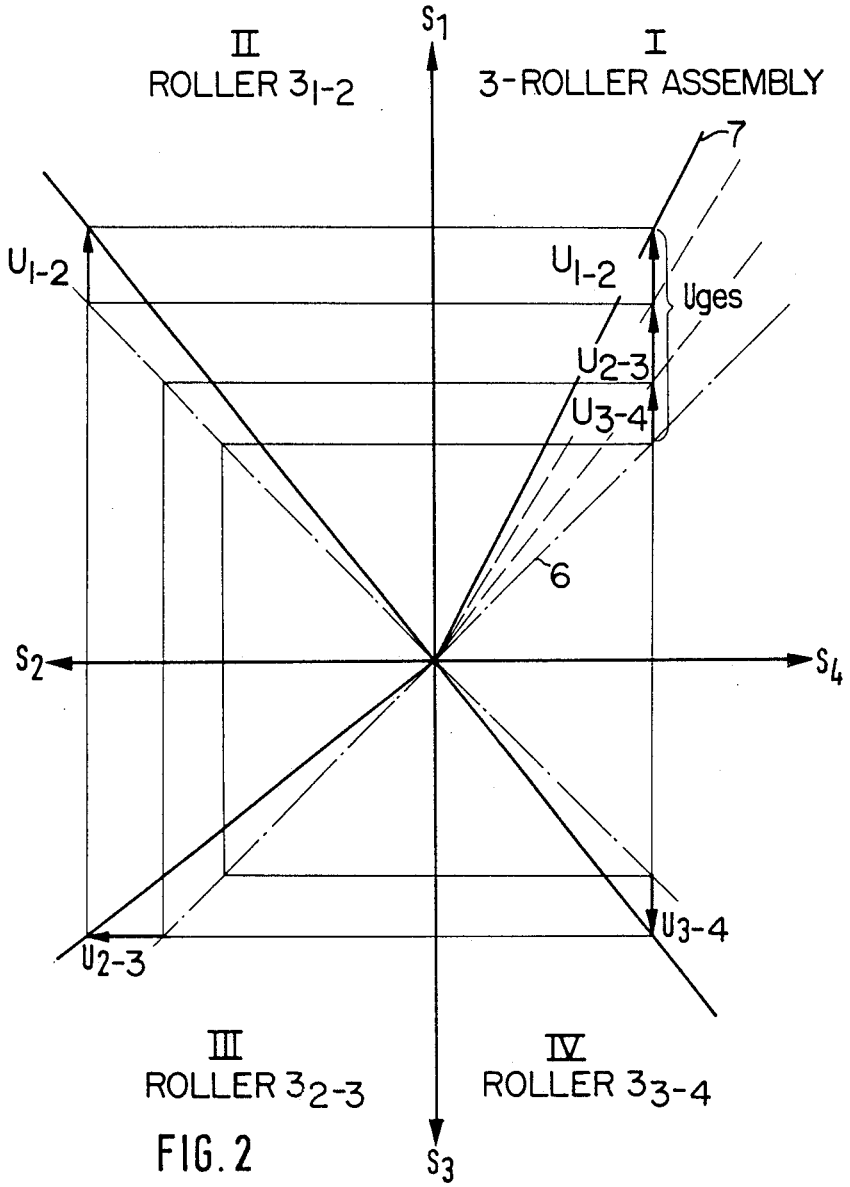
FIG. 2 is a graphical illustration showing the distribution of the total force applied by the cutting wire onto the individual drive rollers for a given value of friction between the cutting wire and the workpiece.

Referring to FIG. 2, the graphical illustration shows a manner of calculating the desired intermediate tensions $S_2$ and $S_3$ in order to provide for a substantially uniform distribution of the difference between the driving tension force $S_1$ and the no-load tension force $S_4$ (i.e., the friction force R) over the three drive rollers $3_{1\text{-}2}$, $3_{2\text{-}3}$, and $3_{3\text{-}4}$.

Referring to FIG. 2, quadrant I may be considered to represent the drive arrangement as a whole, i.e., the driving tension force $S_1$ in wire 1 as it approaches the first drive roller $3_{1-2}$, the no-load tension force $S_4$ acting on the wire as it leaves the last drive roller $3_{3-4}$, and the intermediate tension forces $S_2$ and $S_3$. As noted above, the no-load tension force $S_4$ is maintained constant under all operating conditions. It will be understood that if the cutting wire does not engage the workpiece, all of the tension forces, including $S_1$, will be of magnitudes equal to that of tension force $S_4$ and the operating condition of the cutting assembly would be designated by the dot-dash line 6. However, when the cutting wire engages the workpiece, a frictional force R is introduced in the cutting wire and a force of equal magnitude must be generated by the drive apparatus in the form of a total peripheral force, designated $U_{ges}$ in FIG. 2, which increases the driving tension force $S_1$ relative to the no-load tension force $S_4$ This total peripheral force $U_{ges}$, which is equal to the difference between the drive tension force $S_1$ and the no-load tension force $S_4$, can on the one hand be as large as the frictional forces produced by the drive rollers as determined by the length of the wrapped sectors of all of the driving rollers. The extreme case wherein $S_1$ is at the slide or slip limit critical for the force transmission is represented by the line designated 7 in quadrant I.

On the other hand, avoidance of sliding of the cutting wire with respect to any one of the drive rollers, and the damage to the roller which would result therefrom, is ensured only if the frictional limit of each individual roller is not exceeded. To illustrate this point, the operating state of the three drive rollers $3_{1-2}$, $3_{2-3}$ and $3_{3-4}$ are represented in quadrants II, III and IV of FIG. 2. The slide limit represented by the solid lines in each of the quadrants II-IV is of significantly lower slope than the slope of the solid line 7 in quadrant I since by using a critical frictional value of identical magnitude for all of the drive rollers in the first quadrant, the total wrap-around angle of all three rollers is taken into consideration. On the other hand, in each of the three other quadrants, only that fraction of the total wrap-around angle represented by the angle of the sector of the particular drive roller of that quadrant is taken into account.

It is evident from the foregoing that the peripheral forces U acting at each of the individual drive rollers may become only as large as the no-load tension force $S_4$. The sum of the peripheral forces $U_{1-2}$, $U_{2-3}$ and $U_{3-4}$ produced at the individual drive rollers $3_{1-2}$, $3_{2-3}$ and $3_{3-4}$ respectively, represents the total peripheral force $U_{ges}$ produced by the drive mechanism. For optimum operation in accordance with the invention, the distribution of the total peripheral force $U_{ges}$ between the individual components $U_{1-2}$, $U_{2-3}$ and $U_{3-4}$, independent of the no-load tension force $S_4$, should have a specific relationship. It also follows that in order to utilize a greater total peripheral force $U_{ges}$, the no-load tension force $S_4$ must be increased. The extent to which the no-load tension force $S_4$ can be increased is of course limited to the point at which the driving tension force $S_1$ reaches the tensile strength of the cutting wire.

In order to obtain a condition in which all three of the drive rollers wear uniformly and at the same time enable the three drive motors to have substantially identical capacity, the total peripheral force $U_{ges}$ should be divided into three individual components of equal magnitude. However, this condition can only be approximated under actual operating conditions.

For these reasons, the three drive rollers are arranged in a non-symmetrical manner as illustrated in FIG. 1 to thereby increase the wrap-around angle over which the cutting wire extends around the third drive roller $3_{3-4}$. This in turn increases the otherwise reduced magnitude of the peripheral force $U_{3-4}$ provided by the third drive roller $3_{3-4}$. By increasing the wrap-around angle of the third drive roller $3_{3-4}$, the wrap-around angle of the first drive roller $3_{1-2}$ is reduced which similarly results in reducing the otherwise larger peripheral force provided by the first drive roller.

Thus, an arrangement in accordance with the invention includes means for individually and independently adjusting the peripheral forces provided at each of the three drive rollers by varying the characteristics of the particular motor which drives the same. This step is preferably accomplished in a simple manner without the requirement for measurement and/or control apparatus.

In accordance with the invention, the division of the total peripheral force in a substantially uniform manner over the various drive rollers is accomplished through adjusting the electromechanical properties of the individual motors relative to the particular force transmission requirements.

Figure 3:
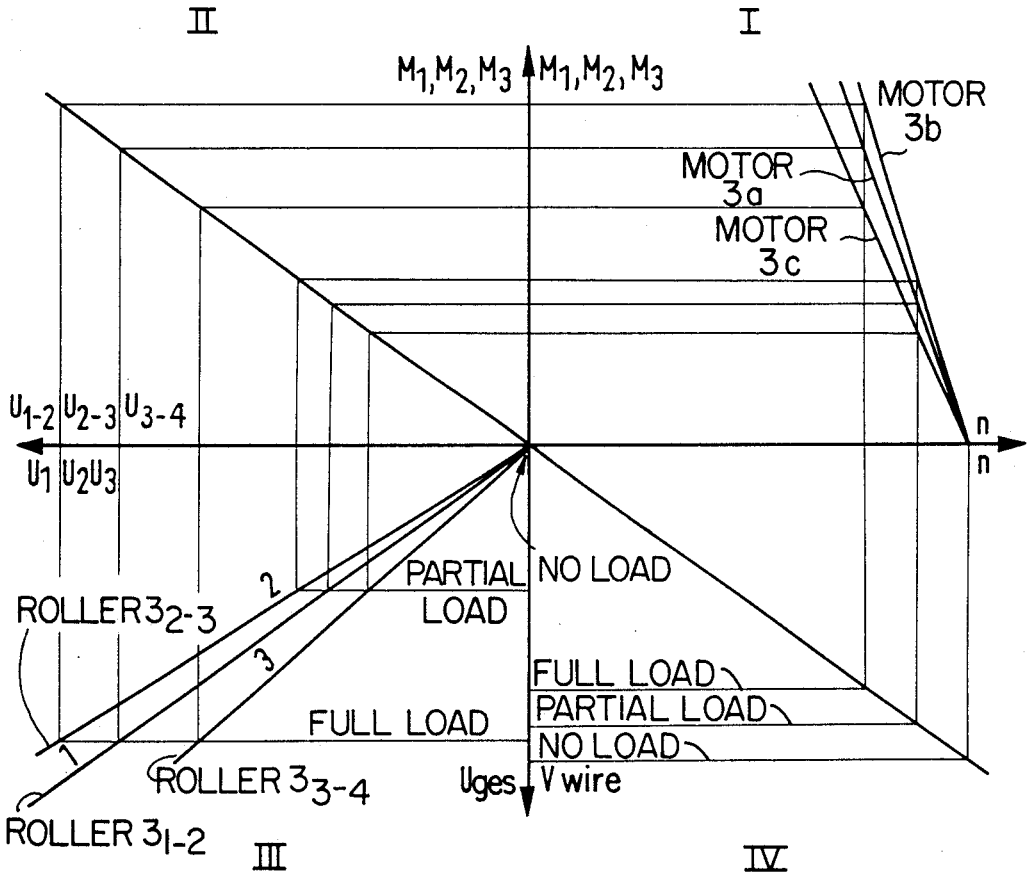
FIG. 3 is a graphical illustration showing the manner in which adjustment of the angular torque and rotational speed of the drive motors affects the distribution of force over the individual drive rollers.

Referring to FIG. 3, the rotational speed (n) to torque (M) characteristics of each of the three drive motors 3*a* are plotted in quadrant I. It is important that each of the motors have shunt motor characteristics since the motor would otherwise operate at excessively high speeds at no-load conditions. The rotational speed of each motor multiplied by the associated roller radius provides the peripheral speed of the drive roller which is to be equated with the wire speed (quadrant IV).

The moment of each motor divided by the associated roller radius yields the peripheral force provided by that drive roller (quadrant II). Both of these inter-relationships are linear and with appropriate scaling, the same straight line can extend within both the second and fourth quadrants.

Since all three drive rollers are coupled by the common cutting wire, the peripheral speed of all three drive rollers for a given operating condition must be identical. Since in the illustrated embodiment, all of the drive rollers have the same diameter, all of the three motors will therefore run at the same rotational speed. As illustrated in quadrant III of FIG. 3, the peripheral forces $U_{1-2}$, $U_{2-3}$ and $U_{3-4}$, each of which can be individually located on the abscissa, can be plotted as the sum $U_{ges}=U_{1-2}+U_{2-3}+U_{3-4}$ on the ordinate. The optimum peripheral force distribution determined according to FIG. 2 can then be represented as a set of straight lines in the third quadrant of FIG. 3.

The relationship between $U_{1-2}$, $U_{2-3}$ and $U_{3-4}$ should maintain a specific value independent of the total peripheral force $U_{ges}$. The torques provided at the drive rollers by the respective peripheral forces acting over the radius of the drive rollers should become effective at substantially the same rotational speed. From this fact, the adjustment of the torque and peripheral speed characteristics of each of the motors can be obtained in the first quadrant of FIG. 3 according to the relationship represented in quadrant III.

As an example, a driving mechanism for a cutting wire apparatus comprising three drive rollers with specified boundary conditions can transmit a total peripheral force of nearly 8N without adjustment of the individual drive motors in accordance with the invention. However, by adjusting the speed and torque characteristics of the individual drives, the total peripheral force can be increased to nearly 10N.

Whereas the wear of the drive rollers of a three-roller arrangement, without adjustment in accordance with the invention, is distributed in a manner such that the first roller exhibits 37.7% of the wear, the second roller exhibits 43.2% of the wear, and the third roller exhibits 19.1% of the wear. Upon adjustment of the speed and torque characteristics of the individual drive motors in accordance with the invention, the distribution of wear independent of the actually transmitted force is 34.0% for the first drive roller, 38.9% for the second drive roller, and 27.2% for the third roller. The substantially uniform distribution of wear obtained in accordance with the invention becomes even more important where the load decreases to about 70 percent of its maximum value in which case, without adjustment in accordance with the invention, 46.6% of the wear is exhibited by the first roller and 53.4% of the wear is exhibited by the second roller, while the third drive roller is not subjected to any wear. If the load decreases to less than one-quarter of its maximum value, the wear is exhibited substantially exclusively on the first drive roller. Thus, the substantially uniform distribution of wear becomes particularly important since cutting wire arrangements of the type with which the invention is concerned are generally operated such that the drive tension force is somewhat less than the maximum and in the occasional case where greater loads act on the wire, the slippage problem is generally handled by appropriate dimensioning of the drive arrangement components.

As noted above, another requirement in the manufacture of wafers of semiconductor material is that the wafer should have surfaces which are as planar and as parallel to each other as possible. This requirement becomes more difficult to achieve where the wafers are obtained by slicing from an ingot using looped cutting wire apparatus. The cutting wire tends to migrate from its intended path during the slicing operation under the effect of process forces as well as the non-uniform cutting capability exhibited by the tool as it is subjected to wear and tear. The resulting surfaces of the wafer cut from the ingot are therefore neither planar nor parallel to each other, but are rather bowed or warped.

Referring to FIG. 4, it is seen that the bowing or warping of a wafer cannot be corrected even through additional conventional processing steps. The separated wafer 20 (FIG. 4*a*) has two uneven surfaces 21 and 22 which give rise to a warp which can be up to a few hundredths of a millimeter. If the surface 22 of wafer 20 is clamped, such as by suction, to a planar table (FIG. 4*b*), the free surface 21 can be machined to a substantially planar state (FIG. 4*c*) so that two substantially planar and parallel surfaces 21' and 22 exist. However, once the wafer 20 is unclamped, the surface 22 of the wafer which was clamped to the flat table will assume its original warped shape (FIG. 4*d*) due to its elasticity. Additional processing steps cannot rectify this problem.

On the other hand, the problem can be solved through an integration of slicing and planing steps. In this connection, reference is made to DE-OS No. 36 13 132 of the applicant.

Referring to FIG. 5, the non-planar front face 25 of the ingot remaining from a previous slicing operation (stage 1) is planed (stage 2) by a suitable machining process. Although grinding is the preferred technique, other processes can be used to obtain planar surface 25', such as milling, turning, and electrolytic and erosive cutting. A wafer 26 is then formed by slicing the ingot (stage 3) by means of cutting wire apparatus in accordance with the invention. This leaves a new non-planar face 25 in the ingot as well as a non-planar surface 27 on the wafer 26. However, since the surface 25' of the separated wafer 26 is substantially planar, it can function as a planar reference surface and be clamped to a flat table without any warp whereupon the opposite surface 27 can be machined to a surface 27' which is substantially planar and parallel to the planar reference surface 25' (stage 4). When the wafer 26 is then removed from its clamping site, it will no longer warp. The non-planar front face 25 of the ingot is then machined to a planar condition preparatory to slicing the next wafer.

It is not important in the method described above whether the front face of the ingot is perpendicular to the ingot axis or in a slanted position.

Thus, an arrangement in which the looped cutting wire is driven by a mechanism in accordance with the foregoing description, and wherein the wafer separation and surface machining steps are in accordance with the method described above in connection with FIG. 5, meets both of the initially stated requirements for manufacturing semiconductor wafers. It is most efficient for the apparatus to comprise a single unit including a combination of looped cutting wire apparatus and surface machining apparatus. It will also be understood that for purposes of savings in time, it is preferred that the machining of the front face of the ingot and the slicing of the wafer not occur sequentially, but, rather, overlap in time with each other.

Reference will now be made to FIGS. 6–10 in which a combined slicing-grinding unit is illustrated for performing the above-described method.

Figure 6A:
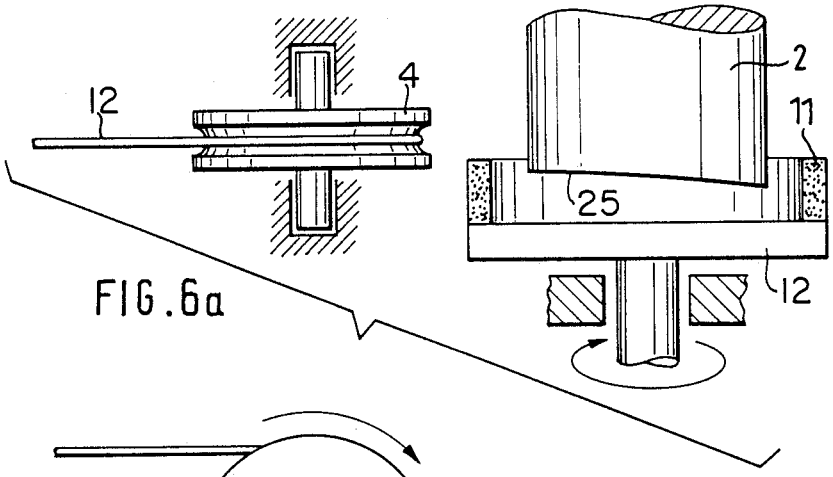
FIGS. 6–10 are schematic illustrations showing the sequence of steps in an arrangement for manufacturing wafers having substantially planar reference surfaces from an ingot of semiconductor material utilizing a grinding machine and looped cutting wire device combined in a single unit.
Figure 6B:
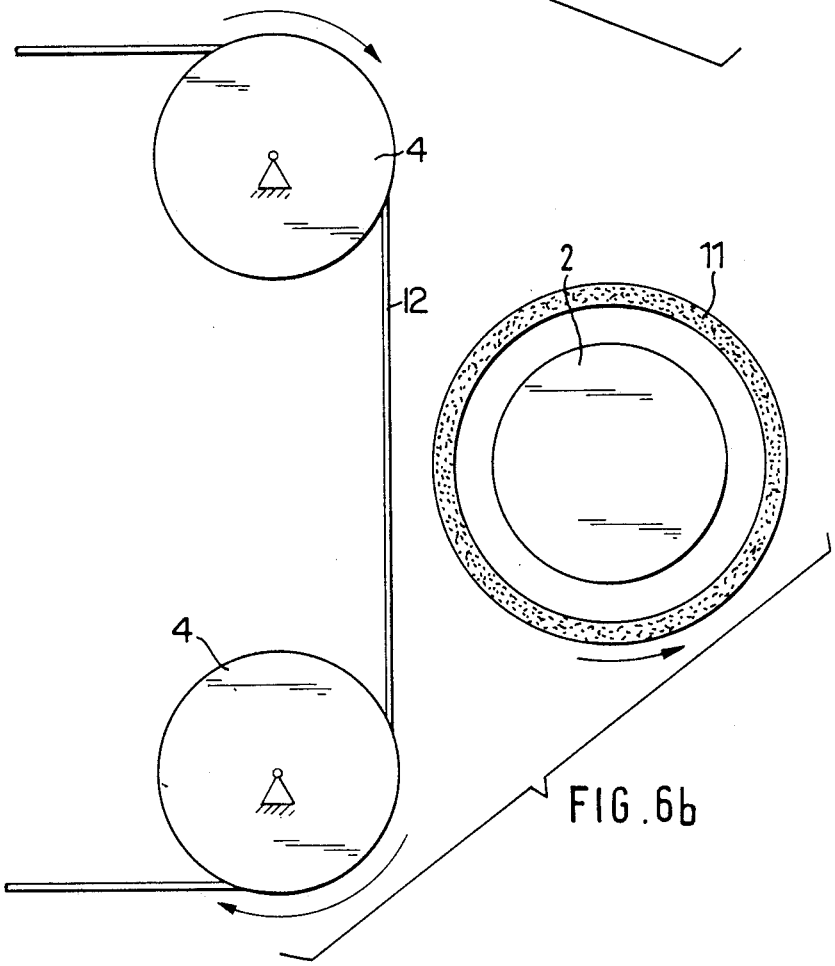
Figure 7A:
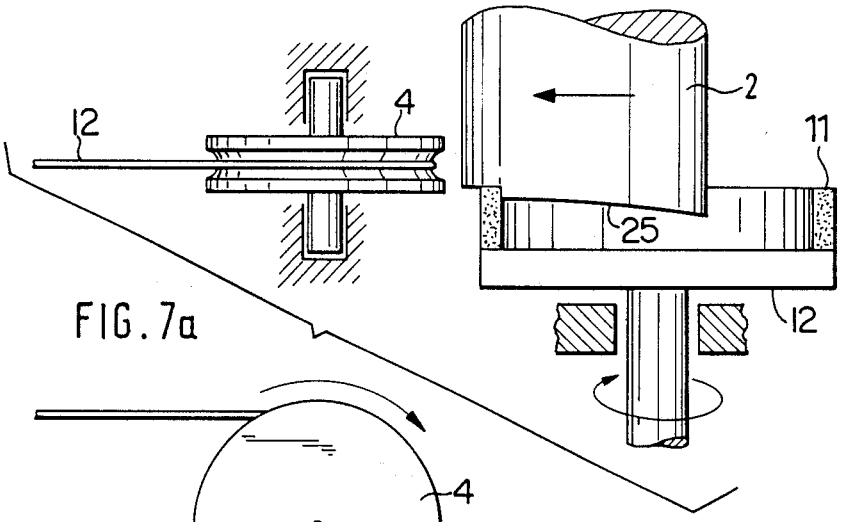
Figure 7B:
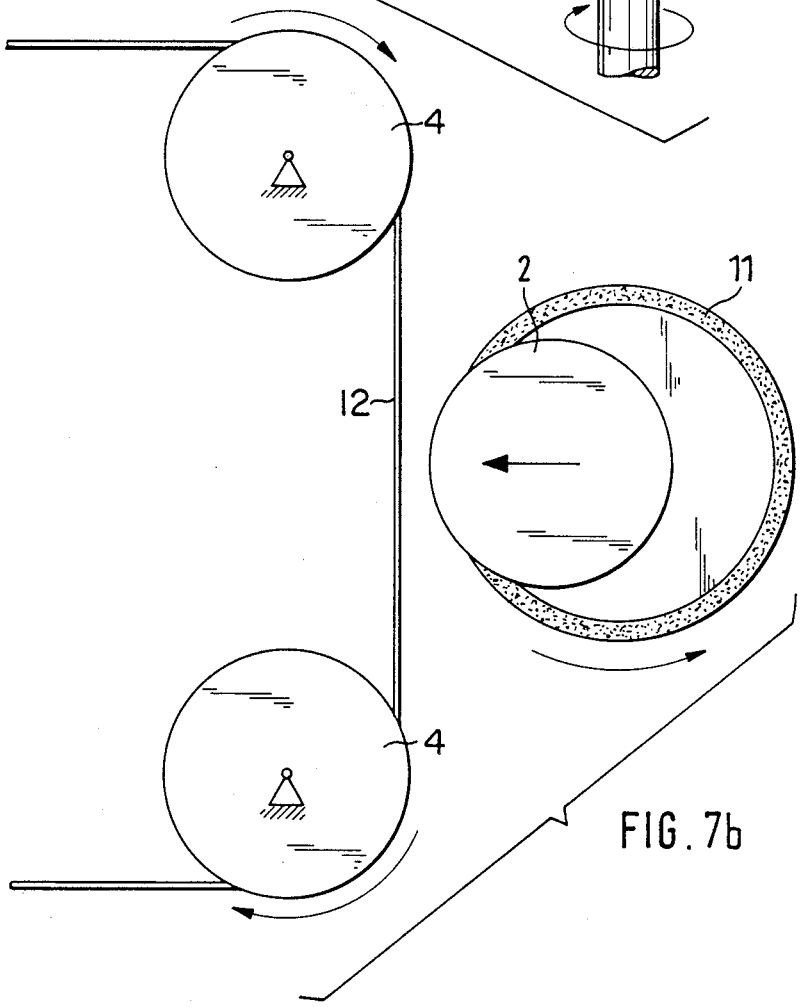
Figure 8A:
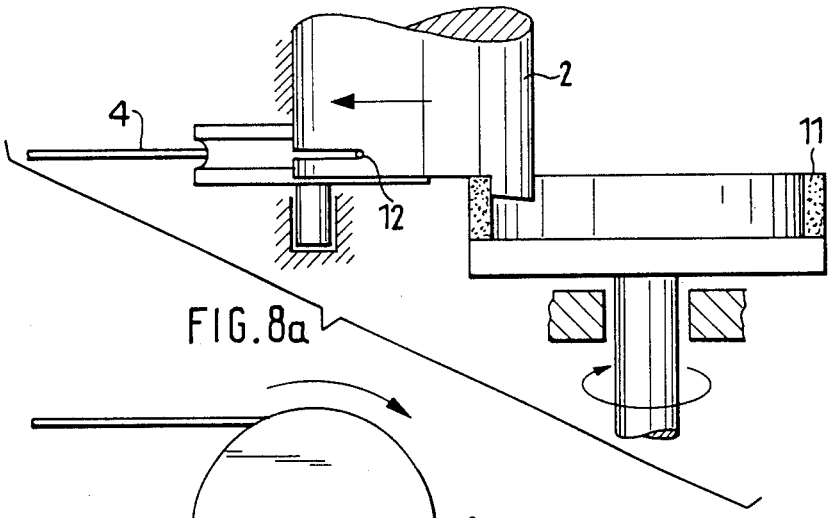
Figure 8B:
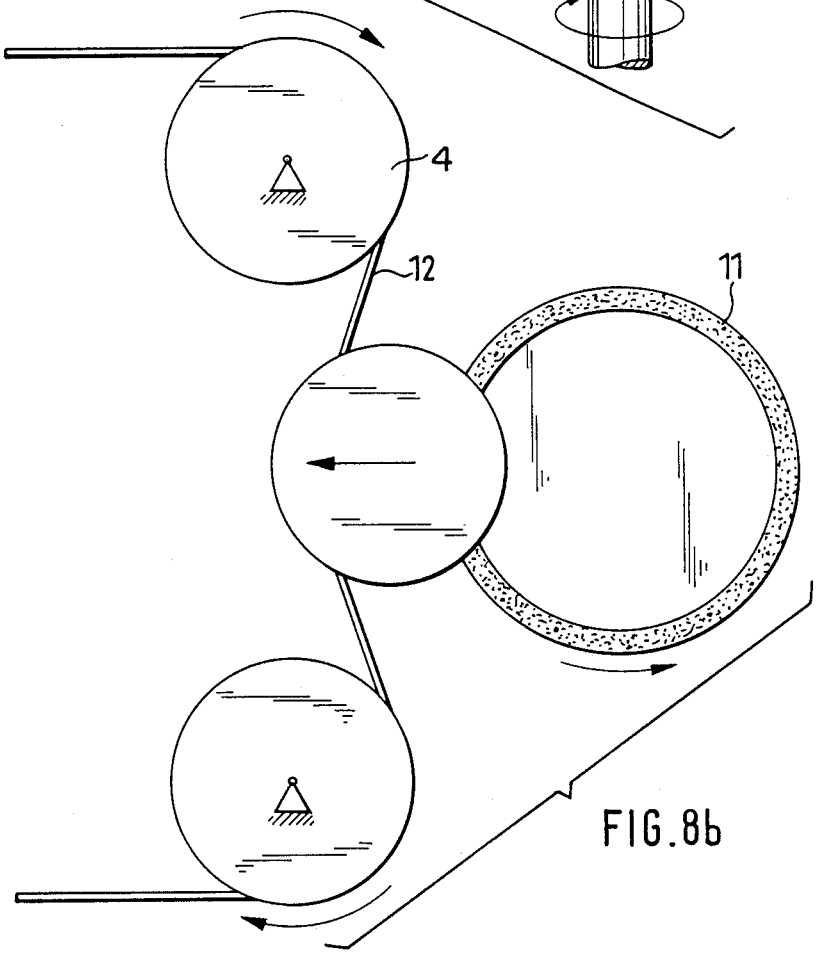
Figure 9A:
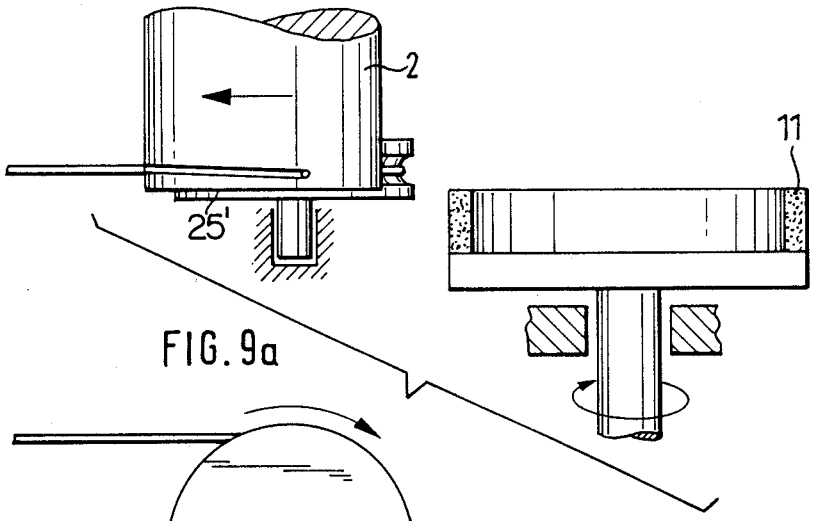
Figure 9B:
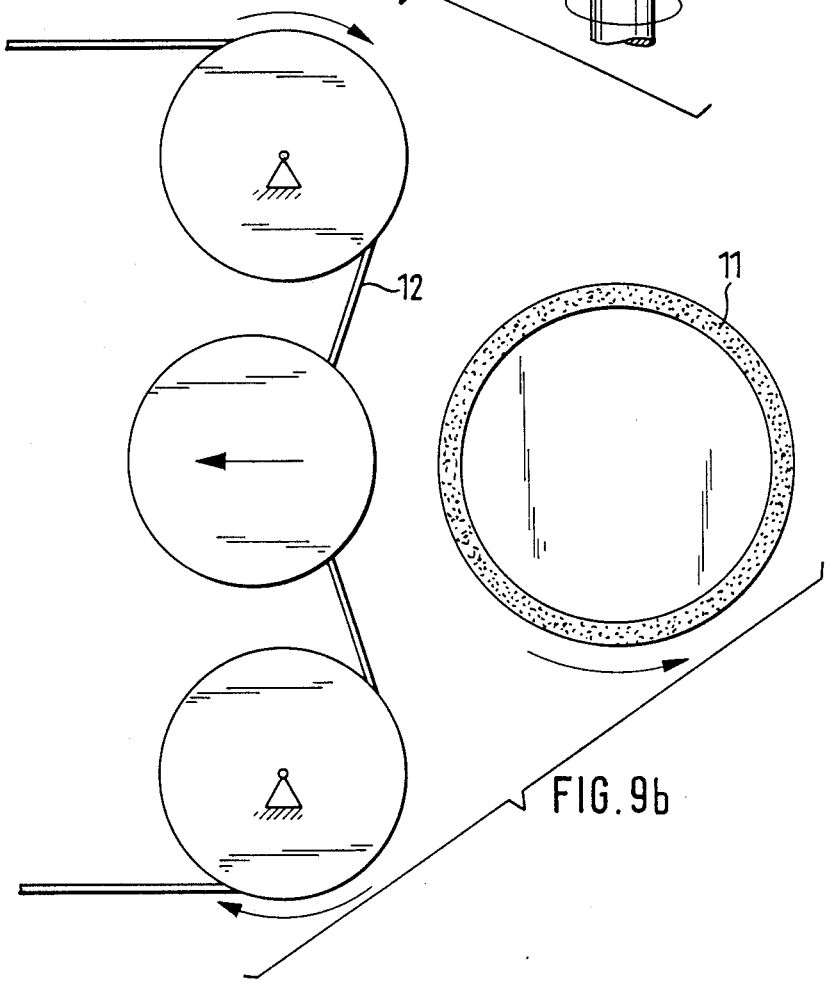
Figure 10A:
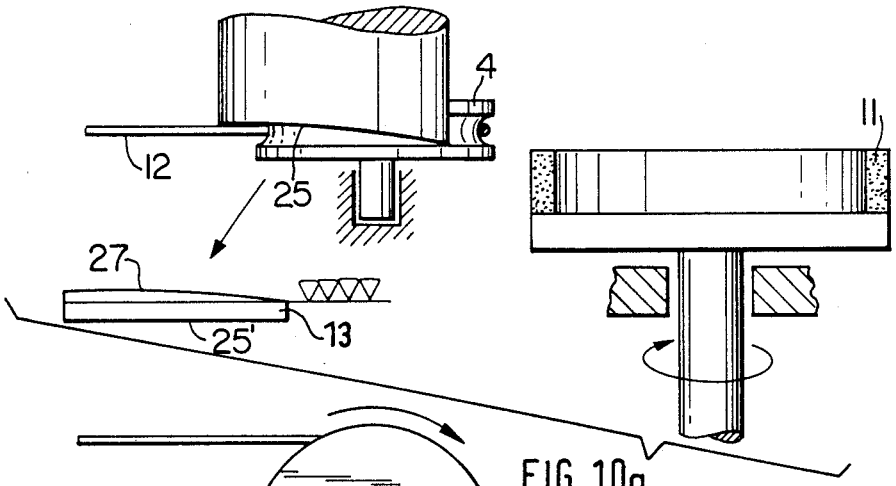
Figure 10B:
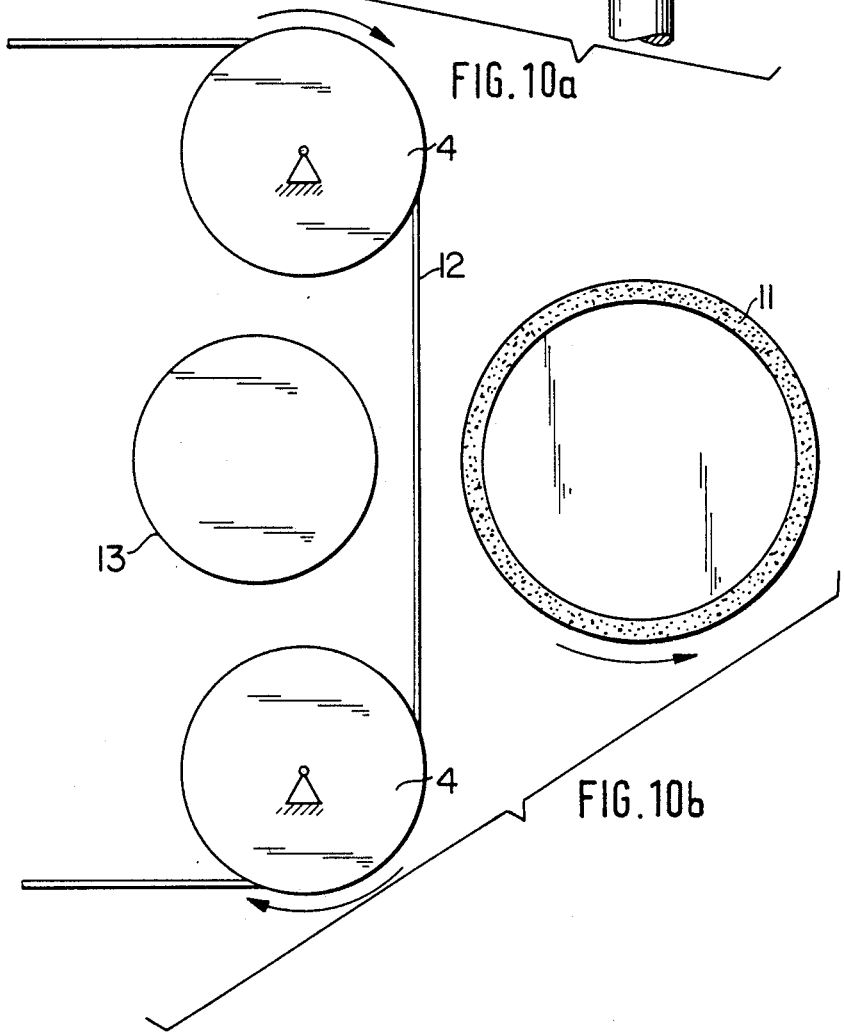

Referring to FIG. 6 in which the apparatus and ingot 2 are illustrated in their initial relative positions, the ingot 2 from which a wafer is to be sliced generally has a non-planar front face 25. The ingot is fixed in a clamp of the grinding device so that its front region projects into an annular grinding body 11 of a rotating abrasive-cup wheel 12 so that the surface 25 is positioned entirely within the annular grinding body 11. The ingot 2 begins its advance movement (FIG. 7) in a substantially radial or transverse direction whereupon the grinding body 11 removes material at the end of the ingot so that the front face of the ingot begins to obtain a planar configuration despite its original geometry.

As the advance movement of ingot 2 continues, the ingot engages the cutting wire 12 (FIG. 8) whereupon the cutting wire 12 begins to cut or slice through the ingot 2. The cut is performed to form a wafer having a thickness which is somewhat greater than that designed for the finished wafer.

With continued advancement of the ingot (FIG. 9), the grinding body 11 becomes disengaged from the front surface of the ingot while the slicing operation is still in progress. The bottom face 25' of the ingot is now substantially planar. Upon completion of the advancement of the ingot (FIG. 10), the wafer 13 is completely sliced from the ingot and includes a substantially planar reference surface 25'. On the other hand, since the cutting wire 12 has drifted under the effects of the processing forces as described above, the opposite surface 27 of the wafer 13 is neither planar nor parallel to surface 25'. Similarly, the newly formed front surface 25 of the ingot has a non-planar geometry. At the end of the slicing process, the wafer 13 is transported from the processing zone. This transport is particularly simple in the case where the apparatus utilizes a looped cutting wire since there is nothing to obstruct the movement of the wafer from the processing zone. The reference surface 25' of wafer 13 is then clamped to a planar clamping table whereupon the non-planar surface 27 is machined to a planar geometry substantially parallel to surface 25'. This last machining step is preferably accomplished by grinding.

Obviously, numerous modifications and variations of the present invention are possible in the light of the above teachings. Therefore, it is to be understood that within the scope of the claims appended hereto, the invention may be practiced otherwise than as specifically disclosed herein.

What is claimed is:

1. In a cutting wire apparatus including a looped cutting wire, an improved drive arrangement comprising:

at least two drive rollers over sectors of which said cutting wire is wrapped;

at least two drive motors, each of said drive motors being associated with a respective one of said drive rollers for driving the same, each of said drive motors having shunt motor characteristics; and said drive motors each including means for adjusting the speed and torque of said motor relative to the load applied to said respective drive roller associated therewith by said cutting wire such that all of said drive rollers participate in driving said cutting wire with substantially the same reliability against slippage.

2. Apparatus as recited in claim 1 wherein said adjusting means of each of said drive motors includes means for adjusting the speed and torque of said motor such that wear of said cutting wire is distributed substantially uniformly over all of said drive rollers.

* * * * *